US011028632B2

(12) United States Patent
Kiwus et al.

(10) Patent No.: US 11,028,632 B2
(45) Date of Patent: Jun. 8, 2021

(54) WINDOW LIFT ASSEMBLY

(71) Applicant: Dr. Ing. h.c. F. Porsche Aktiengesellschaft, Stuttgart (DE)

(72) Inventors: David Kiwus, Stuttgart (DE); Thomas Seibold, Ostfildern (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 77 days.

(21) Appl. No.: 16/532,640

(22) Filed: Aug. 6, 2019

(65) Prior Publication Data

US 2020/0048950 A1 Feb. 13, 2020

(30) Foreign Application Priority Data

Aug. 10, 2018 (DE) ..... 10 2018 119 474.9

(51) Int. Cl.
*E06B 7/00* (2006.01)
*E05F 15/697* (2015.01)
*E05F 15/695* (2015.01)

(52) U.S. Cl.
CPC ..... *E05F 15/697* (2015.01); *E05F 15/695* (2015.01)

(58) Field of Classification Search
CPC ..... E05F 11/385; E05F 11/423; E05F 15/697; E05F 15/60; E05F 15/689; E05F 11/525; E05Y 2900/55; E05Y 2600/314; E05Y 2800/242; B60J 1/17; E05D 15/18; E05D 15/16
USPC ... 49/70, 349, 348, 207, 216, 221, 502, 376, 49/214, 358, 362
See application file for complete search history.

(56) References Cited

U.S. PATENT DOCUMENTS 4,615,143 A 10/1986 Isetani
4,870,333 A * 9/1989 Itoh ..... H02H 7/0851 318/286
5,090,158 A * 2/1992 Bertolini ..... B60J 5/0416 49/348
6,216,394 B1 * 4/2001 Fenelon ..... E05F 15/689 49/349
6,430,874 B1 * 8/2002 Korte ..... B60J 1/17 49/358

(Continued)

FOREIGN PATENT DOCUMENTS

CN 103726750 4/2014
DE 199 61 268 2/2001
GB 455 901 10/1936

OTHER PUBLICATIONS

Great Britain Search Report dated Jan. 30, 2020.
German Examination Report dated May 8, 2019.
Korean Examination Report dated Aug. 21, 2020.

*Primary Examiner* — Chi Q Nguyen
(74) *Attorney, Agent, or Firm* — Gerald E. Hespos; Michael J. Porco; Matthew T. Hespos

(57) ABSTRACT

A window lift assembly (3) of a motor vehicle window (5) has a window pane (4) that can be divided into a first pane region (6) and a second pane region (7) in a width direction (8) of the window pane (4). A first window lift (9) carries the window pane (4) in the first pane region (6) and a second window lift (10) carries the window pane (4) in the second pane region (7). The two window lifts (9,10) are actuable independently of each other to move the window pane (4) rectilinearly up and down, to incline the window pane (4) and/or to move the window pane (4) up and down in an inclined manner.

11 Claims, 1 Drawing Sheet

(56) References Cited

U.S. PATENT DOCUMENTS

| | | | | |
|---|---|---|---|---|
| 6,541,929 | B2 * | 4/2003 | Cregeur | E05F 15/689 160/291 |
| 7,500,711 | B1 * | 3/2009 | Ewing | E05F 15/622 296/146.1 |
| 7,615,944 | B2 * | 11/2009 | Ubelein | B60J 1/17 318/266 |
| 8,109,352 | B2 * | 2/2012 | Asbach | B62K 9/00 180/65.1 |
| 9,879,464 | B2 * | 1/2018 | Hernandez-Urbina | E05F 15/689 |
| 2002/0007599 | A1 | 1/2002 | Pacella et al. | |
| 2002/0184825 | A1 | 12/2002 | Ayran | |
| 2009/0000202 | A1 * | 1/2009 | Eckhardt | E05F 11/385 49/352 |
| 2011/0192088 | A1 * | 8/2011 | Zellmer | E05F 15/73 49/358 |
| 2012/0005963 | A1 * | 1/2012 | Zellmer | G05B 13/024 49/358 |
| 2019/0071914 | A1 * | 3/2019 | Bars | E05F 15/689 |

* cited by examiner

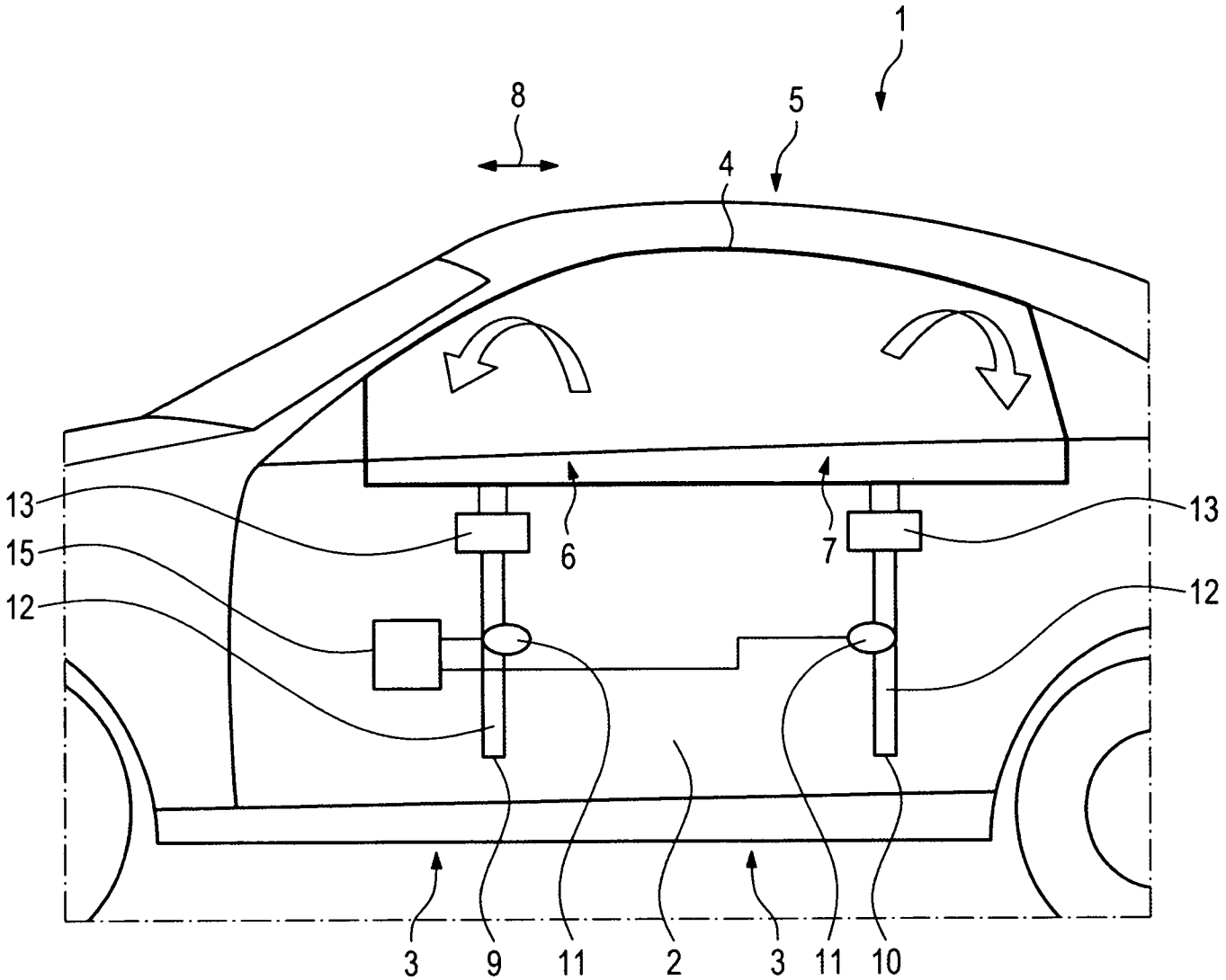
1
5
4
8
13
12
7
6
10
11
3
2
11
9
3
13
15
12

WINDOW LIFT ASSEMBLY

CROSS REFERENCE TO RELATED APPLICATION

This application claims priority under 35 USC 119 to German Patent Appl. No. 10 2018 119 474.9 filed on Aug. 10, 2018, the entire disclosure of which is incorporated herein by reference.

BACKGROUND

Field of the Invention

The invention relates to a window lift assembly, in particular for a door of a motor vehicle.

Related Art

Window lift assemblies for doors of motor vehicles are well known in the prior art. Earlier motor vehicles had a window pane with a manually operable mechanism in which a carriage is held movably on a rail. The carriage bears the window pane and moves together with the window pane along the rail by means of a crank and a cable pull to lower the window pane for opening the window or to raise the window pane for closing the window.

Modern motor vehicles use an electrically activatable electric motor drive in place of the manually actuated mechanism. The electric motor raises or lowers a window lift rail that carries the pane. The window pane runs laterally in guides on the vehicle door so that the window pane can be lowered and raised rectilinearly. Window lift assemblies of this general type are found virtually in all modern motor vehicles.

The window panes in motor vehicles that have wider vehicle doors also have correspondingly wider window panes. However, known window lift assemblies require the entire wide window to be lowered or raised integrally over the full width. This requirement has disadvantages on passenger comfort and negative pressure behavior.

It is an object of the invention to provide a window lift assembly that reduces or eliminates the disadvantages in the prior art, in particular for motor vehicle windows of increased width. It is also an object of the invention to provide an improved vehicle door. Furthermore, it is an object to provide an improved motor vehicle, and a method for activating a window lift assembly to achieve improved comfort.

SUMMARY

An embodiment of the invention relates to a window lift assembly of a motor vehicle window having a window pane. The window pane can be divided into at least one first pane region and a second pane region in the width direction of the window pane. The window lift assembly has first and second window lifts. The first window lift carries the window pane in a first pane region and the second window lift carries the window pane in a second pane region. The two window lifts are actuable independently of each other to move the window pane rectilinearly up and down, to incline the window pane and/or to move the window pane up and down in an inclined manner. Thus, the window pane can be opened and closed or left open in a slanted state. For example, a side window may have a side window pane that may be open at the front or rear in the direction of travel and closed at the rear or front in the direction of travel.

Windows on conventional vehicle doors are likely to have a width less than a dimension of one seat row. However, wide vehicle doors may have a window pane that extends over more than just one seat row and possibly over two seat rows.

The first window lift may be arranged away from the second window lift in a width direction of the window pane, and the regions of the window lifts that directly carry the pane may be spaced apart in a width direction of the window pane. The window pane together with the two window lifts can therefore be arranged securely. A secure installation can thus be achieved even in the case of wider vehicle windows.

The first and second window lifts may be provided respectively with first and second drive motors, such as electric motors. As a result, individual activation and actuation can take place to move the window pane up or down rectilinearly or slanted or to slant the window pane.

A control unit may be provided to control or regulate actuation of the first and second window lifts, and particularly the first and second drive motors. Thus, the movement speed and angle of the slant can be controlled in a targeted manner.

The invention also relates to a vehicle door having the above-described a window lift assembly.

The invention further relates to a motor vehicle having the above-described vehicle door.

The invention also relates to a method for activating a window lift assembly so that in a first operating mode, the first window lift and the second window lift are activated simultaneously and identically in such a manner that the window pane is lowered or raised rectilinearly and without tilting with respect to its width direction.

In a second operating mode, the first window lift may be activated for lowering to a greater extent than the second window lift such that the window pane is slanted with respect to its width direction, or the second window lift may be activated for lowering to a greater extent than the first window lift such that the window pane is slanted with respect to its width direction, or the first window lift may be activated for raising to a greater extent than the second window lift such that the window pane is slanted with respect to its width direction, or the second window lift may be activated for raising to a greater extent than the first window lift such that the window pane is slanted with respect to its width direction.

In a third operating mode, the first window lift and the second window lift may be activated simultaneously and identically in such a manner that the previously slanted window pane is lowered or raised slanted with respect to its width direction.

In a fourth operating mode, the first window lift may be activated for lowering to a greater extent than the second window lift such that the previously slanted window pane is straightened with respect to its width direction, or the second window lift may be activated for lowering to a greater extent than the first window lift such that the previously slanted window pane is straightened with respect to its width direction, or the first window lift may be activated for raising to a greater extent than the second window lift such that the previously slanted window pane is straightened with respect to its width direction, or the second window lift may be activated for raising to a greater extent than the first window lift such that the previously slanted window pane is straightened with respect to its width direction.

An embodiment is explained in detail below with reference to the drawing.

BRIEF DESCRIPTION OF THE DRAWINGS

FIG. 1 is a schematic lateral partial illustration of a motor vehicle having a vehicle door with a window lift assembly according to the invention.

DETAILED DESCRIPTION

FIG. 1 shows part of a motor vehicle 1 having a door 2 with a window lift assembly 3 for actuating or for lifting and lowering a window pane 4 of a motor vehicle window 5.

The window pane 4 preferably is guided in the motor vehicle window 5 and is carried by the window lift assembly 3.

The window pane 4 advantageously is divided into at least one first pane region 6 and a second pane region 7 in the width direction 8 of the window pane 4.

The window lift assembly 3 here has at least one first window lift 9 and a second window lift 10. The first window lift 9 carries the window pane 4 in the first pane region 6 and the second window lift 10 carries the window pane 4 in the second pane region 7.

Each respective window lift 9, 10 has a drive motor as the electric motor 11, a window lift rail 12 and a carrying element 13 that carries the window pane.

In the illustrated embodiment, the window pane 4 is wide design and extends, for example, over two seat rows of the motor vehicle 1.

The two window lifts 9, 10 are actuable independently of each other to move the window pane rectilinearly up and down, to incline the window pane and/or to move the window pane up and down in an inclined manner.

The first window lift 9 is arranged away from the second window lift 10 in a width direction 8 of the window pane 4, and the regions of the window lifts, the carrying elements 13 that directly carry the window pane 4 are spaced apart from one another in a width direction 8 of the window pane 4.

Furthermore, a control unit 15 controls or regulates the driving motors 11 that actuate the first window lift 9 and the second window lift 10.

The window lift assembly 3 can be operated with a method for activating a window lift assembly 3 so that in a first operating mode the first window lift 9 and the second window lift 10 are activated simultaneously and identically in such a manner that the window pane 4 is lowered or raised rectilinearly and without tilting with respect to its width direction 8.

In a second operating mode, the first window lift 9 is activated for lowering to a greater extent than the second window lift 10 such that the window pane 4 is slanted with respect to its width direction 8, or the second window lift 10 is activated for lowering to a greater extent than the first window lift 9 such that the window pane 4 is slanted with respect to its width direction 8, or the first window lift 9 is activated for raising to a greater extent than the second window lift 10 such that the window pane 4 is slanted with respect to its width direction 8, or the second window lift 10 is activated for raising to a greater extent than the first window lift 9 such that the window pane 4 is slanted with respect to its width direction 8.

In a third operating mode, the first window lift 9 and the second window lift 10 are activated simultaneously and identically in such a manner that the previously slanted window pane 4 is lowered or raised slanted with respect to its width direction 8.

In a fourth operating mode, the first window lift 9 is activated for lowering to a greater extent than the second window lift 10 such that the previously slanted window pane 4 is straightened with respect to its width direction 8, or the second window lift 10 is activated for lowering to a greater extent than the first window lift 9 such that the previously slanted window pane 4 is straightened with respect to its width direction 8, or the first window lift 9 is activated for raising to a greater extent than the second window lift 10 such that the previously slanted window pane 4 is straightened with respect to its width direction 8, or the second window lift 10 is activated for raising to a greater extent than the first window lift 9 such that the previously slanted window pane 4 is straightened with respect to its width direction 8.

The vehicle door 2 may be a wing door that can be pivoted open laterally, as is the case in conventional vehicles in which the vehicle door pivots about a vertical axis, and also can pivot up, for example about an axis that runs obliquely with respect to the vertical. Alternatively, the vehicle door 2 can be a door that pivots open laterally about a vertical axis.

The motor vehicle 1 in the illustrated embodiment does not have a B pillar, but the motor vehicle 1 can have a B pillar.

LIST OF REFERENCE SIGNS

1 motor vehicle
2 door
3 window lift assembly
4 window pane
5 motor vehicle window
6 first pane region
7 second pane region
8 width direction
9 first window lift
10 second window lift
11 electric motor
12 window lift rail
13 carrying element
15 control unit

What is claimed is:

1. A window lift assembly of a motor vehicle window having a window pane, the window pane having a first pane region and a second pane region separate from the first pane region in a width direction of the window pane, where the width direction of the window pane is transverse to a lift direction of the window pane, the window lift assembly comprising: a first window lift and a second window lift, wherein the first window lift carries the window pane in the first pane region and the second window lift carries the window pane in the second pane region, the two window lifts being actuable independently of each other to move the window pane rectilinearly up and down, to incline the window pane or to move the window pane up and down in an inclined manner.

2. The window lift assembly of claim 1, wherein the first window lift is arranged away from the second window lift in the width direction of the window pane, and the regions of the window lifts that directly carry the window pane are spaced apart in the width direction of the window pane.

3. The window lift assembly of claim 1, wherein the first window lift and the second window lift each have an electric drive motor.

4. The window lift assembly of claim 3, further comprising a control unit that controls or regulates actuation of the drive motors of the first window lift and the second window lift.

5. A vehicle door having the window lift assembly of claim 1.

6. A motor vehicle having the vehicle door of claim 5.

7. The window lift assembly of claim 1, wherein the width direction of the window pane extends along a travel direction of the motor vehicle.

8. The window lift assembly of claim 1, wherein the first and second window lifts are selectively actuable in opposite directions.

9. A method for controlling air flow through a motor vehicle window having a window pane with opposite front and rear end regions provided respectively front and rear window lifts, the method comprising: achieving a first air flow pattern through the motor vehicle window by operating the front and rear window lifts simultaneously and in a common direction for moving the window pane rectilinearly, and achieving a second air flow pattern different from the first air flow pattern by operating one of the front and rear window lifts differently than the other of the front and rear window lifts to achieve slanted orientation of the window pane.

10. The method of claim 9, further comprising operating the front and rear window lifts simultaneously and in a common direction after achieving the slanted orientation of the window pane.

11. The method of claim 10, further comprising operating one of the front and rear window lifts differently than the other of the front and rear window lifts to achieve a rectilinear orientation of the window pane.

* * * * *